US010272322B2

(12) United States Patent
Kim

(10) Patent No.: US 10,272,322 B2
(45) Date of Patent: Apr. 30, 2019

(54) WORD GAME WITH MULTI-SIDED PIECES WITH NOTCHES FOR INTERLOCKING OF THE PIECES AT VARIOUS ANGLES

(71) Applicant: Douglas Shin Kim, Oakland, CA (US)

(72) Inventor: Douglas Shin Kim, Oakland, CA (US)

( * ) Notice: Subject to any disclaimer, the term of this patent is extended or adjusted under 35 U.S.C. 154(b) by 0 days.

(21) Appl. No.: 14/693,660

(22) Filed: Apr. 22, 2015

(65) Prior Publication Data

US 2016/0310835 A1 Oct. 27, 2016

(51) Int. Cl.

| | |
|---|---|
| ***A63F 9/00*** | (2006.01) |
| ***A63F 3/04*** | (2006.01) |
| ***A63F 3/00*** | (2006.01) |
| *A63F 9/12* | (2006.01) |

(52) U.S. Cl.

CPC ..... *A63F 3/0423* (2013.01); *A63F 3/00697* (2013.01); *A63F 2003/00719* (2013.01); *A63F 2009/128* (2013.01)

(58) Field of Classification Search

CPC ..... A63H 33/06; A63H 33/08; A63F 9/0098; A63F 9/1204

USPC ..... 273/272, 299; 434/171; 446/108, 446/111–115

See application file for complete search history.

(56) References Cited

U.S. PATENT DOCUMENTS

RE2,528 E * 3/1867 Hill ..... 434/159
1,012,574 A * 12/1911 Adams ..... A63F 1/02 273/299
1,371,619 A * 3/1921 Greenstreet ..... A63H 33/06 446/124
1,569,427 A * 1/1926 Kurtz ..... A63H 33/16 24/563
2,072,605 A * 3/1937 Palmer ..... A63F 9/20 273/294
2,338,738 A * 1/1944 Rebholz ..... A63H 3/16 446/100
2,633,662 A * 4/1953 Nelson ..... A63H 33/06 376/459
2,886,325 A 5/1955 Long
2,984,935 A * 5/1961 Beck ..... A63H 33/06 446/114
3,333,351 A * 8/1967 Williams ..... G09B 1/36 273/156
3,391,476 A * 7/1968 Sher ..... G09B 19/06 434/171
3,537,706 A * 11/1970 Heavener, Jr. ..... A63H 33/06 273/459
3,564,758 A * 2/1971 Willis ..... A63H 33/06 428/542.2

(Continued)

FOREIGN PATENT DOCUMENTS

EP 85302841.3 11/1985
WO WO 2009/089582 A1 7/2009

*Primary Examiner* — William M Pierce

(57) ABSTRACT

Game apparatus comprising a plurality of multi-sided, game and base pieces having notches whereby the pieces may be interlocked, and said pieces having two faces with indicia or other markings on at least some of the faces whereby words and/or equations and/or other things can be formed along horizontal and/or vertical and/or diagonal axes by placing game pieces adjacent to each and/or game pieces and/or base pieces interlocked into each other. Methods for playing games with said apparatus in two and/or three dimensions is disclosed.

7 Claims, 11 Drawing Sheets

(56) References Cited

U.S. PATENT DOCUMENTS 3,570,169 A * 3/1971 Jacob ..... A63H 33/06 446/114
3,698,124 A * 10/1972 Reitzel ..... A63H 33/06 428/542.2
3,855,748 A * 12/1974 Thomas ..... A63B 9/00 446/115
3,930,651 A 1/1976 Rader
3,940,100 A * 2/1976 Haug ..... A47B 3/00 248/165
4,776,597 A 10/1988 Rudell
D304,218 S * 10/1989 Klitsner ..... D21/496
5,203,706 A * 4/1993 Zamir ..... G09B 1/16 434/159
5,209,480 A * 5/1993 Katz ..... A63F 9/10 273/157 R
5,324,040 A * 6/1994 Panda ..... A63F 3/0423 273/258
5,337,501 A * 8/1994 Amanze ..... G09F 7/04 273/239
5,554,062 A * 9/1996 Goldsen ..... A63F 9/0098 434/171
5,628,666 A * 5/1997 Tomczyk ..... A63F 9/1288 446/114
5,702,105 A * 12/1997 Glikmann ..... A63F 9/0098 273/156
5,799,943 A 9/1998 Morgan
5,827,104 A * 10/1998 Zheng ..... A63F 9/12 273/160
5,833,512 A * 11/1998 Nicola ..... A63H 33/08 446/114
6,089,941 A * 7/2000 Glickman ..... A63H 33/101 446/108
6,149,487 A * 11/2000 Peng ..... A63H 33/08 446/108
6,511,073 B2 * 1/2003 Simonds ..... A63F 9/0098 273/156
6,676,474 B2 * 1/2004 Glickman ..... A63H 33/062 446/120
6,951,069 B1 * 10/2005 Talbot-Kelly ..... A47G 1/14 40/764
7,118,110 B2 * 10/2006 Kowalczyk ..... A63F 3/0423 273/236
D605,236 S * 12/2009 Sinisi ..... D21/502
7,695,357 B2 * 4/2010 Fleury ..... A63F 3/00 273/236
8,672,328 B2 * 3/2014 Bazarko ..... A63F 9/0098 273/272
8,746,699 B1 * 6/2014 Pruzan ..... A63F 9/26 273/156
9,382,932 B2 * 7/2016 Nelson ..... F16B 7/0446
9,458,872 B2 * 10/2016 Nelson ..... F16B 7/0446
2002/0056964 A1 * 5/2002 Simonds ..... A63F 9/0098 273/299
2004/0090009 A1 * 5/2004 Mortimer ..... A63F 3/0423 273/299
2008/0132304 A1 * 6/2008 Fleury ..... A63F 3/00 463/11
2010/0109247 A1 * 5/2010 Cernansky ..... A63F 3/0423 273/293
2012/0274027 A1 * 11/2012 Bazarko ..... A63F 9/0098 273/299
2014/0220853 A1 * 8/2014 Draghicescu ..... A63H 33/084 446/108
2015/0099417 A1 * 4/2015 Draghicescu ..... A63H 33/08 446/108

* cited by examiner

WORD GAME WITH MULTI-SIDED PIECES WITH NOTCHES FOR INTERLOCKING OF THE PIECES AT VARIOUS ANGLES

CROSS-REFERENCE TO RELATED APPLICATION

This application claims the benefit of provisional patent application No. 61/995,912, filed 23 Apr. 2014 by the present inventor.

FEDERALLY SPONSORED RESEARCH

Not Applicable

SEQUENCE LISTING OR PROGRAM

Not Applicable

BACKGROUND

Field

This application relates to games, specifically to word construction apparatus or game comprising interlocking pieces used to create words as three-dimensional structures or words along vertical and/or horizontal and/or diagonal axes on a flat surface and method.

Prior Art

Games forming game pieces bearing individual letters into words are a favorite form of recreation and entertainment. Among games of this genre two that are very popular are: Scrabble™ and Bannagrams®. The former involves placing letter tiles on a two dimensional game board to form words vertically and/or horizontally, and the latter does much the same without the use of a board. While scoring and winning is figured differently in these two games, the ability to form words from game pieces bearing individual letters is fundamentally the challenge presented and rewarded in them. Nonetheless there are at least two limitations inherent in these games. First, words can only be formed in two dimensions, namely the horizontal (or "X") axis and the vertical (or "Y") axis. Second, because the game pieces are square shaped, words can only be formed by placing the game pieces above/below each other, and/or to the right or left of each other. Put another way, words can only be formed so they can be read vertically or horizontally. Using square game pieces it is not possible to create or read words that run along diagonal axes. Finally, game pieces in Scrabble™ and Bannagrams® can not be used to form words along up or down relative to a given flat surface. In other words, they limit competition to just two axes (the "X" and "Y" axes) and are unable to encompass the Z axis.

There have been many efforts to create "three-dimensional" word games. These include U.S. Pat. No. 3,930,651 to Rader (1976) which discloses word game apparatus comprising a cube configured so it can receive six-sided game pieces similar to dice into recesses in the cube to form words. The cube has nine recesses, arranged in a three-by-three grid, on each of its six sides thus limiting the words formed to no more than three letters. While this is an interesting concept the nature of the grid on the cube limits play to very short words.

A U.S. Pat. No. 5,702,105 to Glickmann (1997) discloses game pieces that are essentially spherical or cubic in shape and have at least one connector hole. By use of a variety connectors these game pieces can be attached to one another to form words along any one of three orthogonal axes. This game overcomes the three letter limitation of Rader's invention, allowing for words with four or more letters. However, Glickmann's invention requires the use of connectors to join the game pieces as they are not "interlockable" by themselves.

A number of other inventions involve interlockable game pieces, said game pieces bearing alphabetical indicia so they can form words when joined together. However, all of these inventions require a game board that serves as a base to add stability to the game pieces as they are stacked and arranged to create words. A U.S. Pat. No. 5,799,943 to Morgan (1998) discloses a three-dimensional word game that comprises dice like game pieces with depressions and projections supported by a game board that has a plurality of depressions as well. Likewise the playing pieces disclosed by Rudell in U.S. Pat. No. 4,776,597 (1988) fit into the game board disclosed in the same specification. A "three dimensional crossword puzzle" disclosed by Long in U.S. Pat. No. 2,886,325 (1955) is another type of word game comprising the use of indicia bearing game pieces that fit into a special "box" to provide stability and facilitate forming words. The concept of supporting alphabetical indicia bearing game pieces into a base or game board can be found as early as 1865 as disclosed by McDougall in U.S. Pat. No. 176,144. A WIPO No. 2009/089582 A1 to Tefaye (2009) discloses interlocking game pieces that fit into a game board that has four stations in which the game pieces can be based. European Patent No. 85302841.3 to Capo (1985) discloses another three dimensional word game comprising a plurality of cube shaped game pieces bearing letters on each side, that can be joined together by means of a connector that goes through an aperture in the center of each face of the cube. However, like the other inventions cited above, a game board or base is required to anchor and support the cubes vertically.

SUMMARY

The invention is a game comprising interlockable game and base pieces used to form one or more words, numbers, equations, and/or formulae on a flat surface along vertical and/or horizontal and/or diagonal axes and/or in one or more orientations of vertical and/or horizontal in three-dimensions above one or more interlocked base and game pieces supported by a flat surface. The game pieces have a front face, a back face and a plurality of sides with at least two sides having a notch on said sides, at least some of the faces having a number, letter or indicia on them. Each base piece has a plurality of sides and at least one notch on at least one of the plurality of sides, whereby a game piece can be interlocked at an angle with a base piece to hold the game piece in a stable manner and whereby two or more game pieces can be interlocked with each other to form one or more words, numbers, formulas and/or equations along a vertical axis or axes perpendicular and/or parallel to the surface on which the interlocked game piece and base piece rest.

BRIEF DESCRIPTION OF THE DRAWINGS

In the drawings, closely related figures have the same number but different alphabetic suffixes.

FIG. 1 at FIG. 1*d* is a front view of a base piece having six sides, one notch in a top-side opposite the bottom side. The notch is labeled 1*b*, and the open end of the notch is identical to the ones labeled in FIG. 1 at FIG. 1*a*.

DETAILED DESCRIPTION AND BEST MODE

Figure 1:
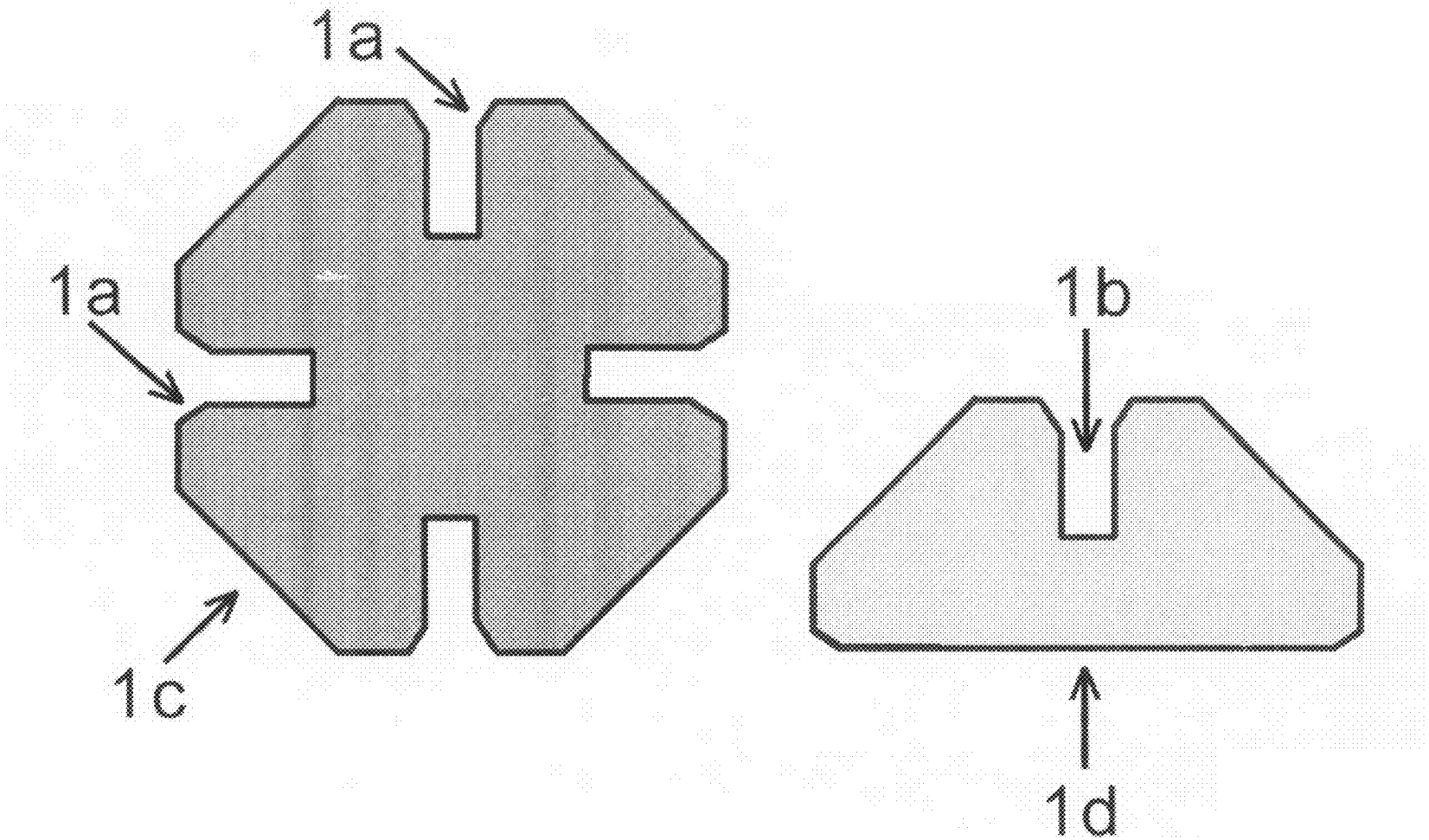
FIG. 1 at FIG. 1*c* is a front view of a game piece having 8 sides with a notch in each of the four vertical or horizontal sides. The open ends of the notches are labeled FIG. 1*a* in FIG. 1, and the notches are identical to the one labeled FIG. 1*b* in FIG. 1.
Figure 2:
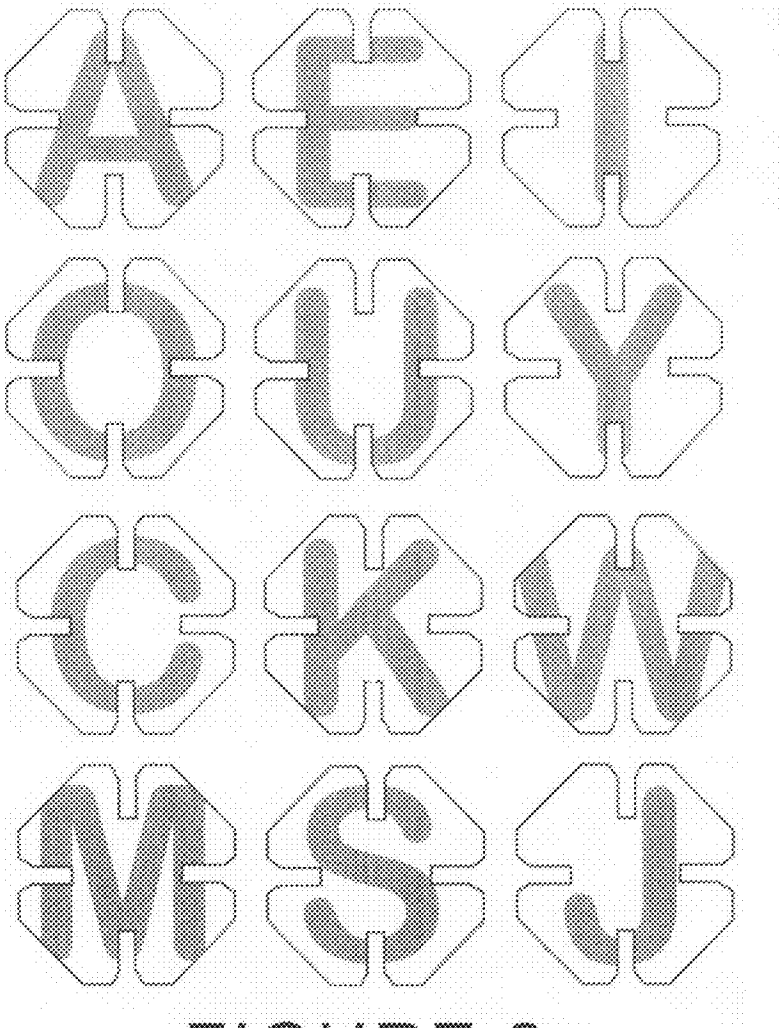
FIG. 2 is a front view of a plurality of game pieces, each having a letter on the frontal face.
Figure 3:
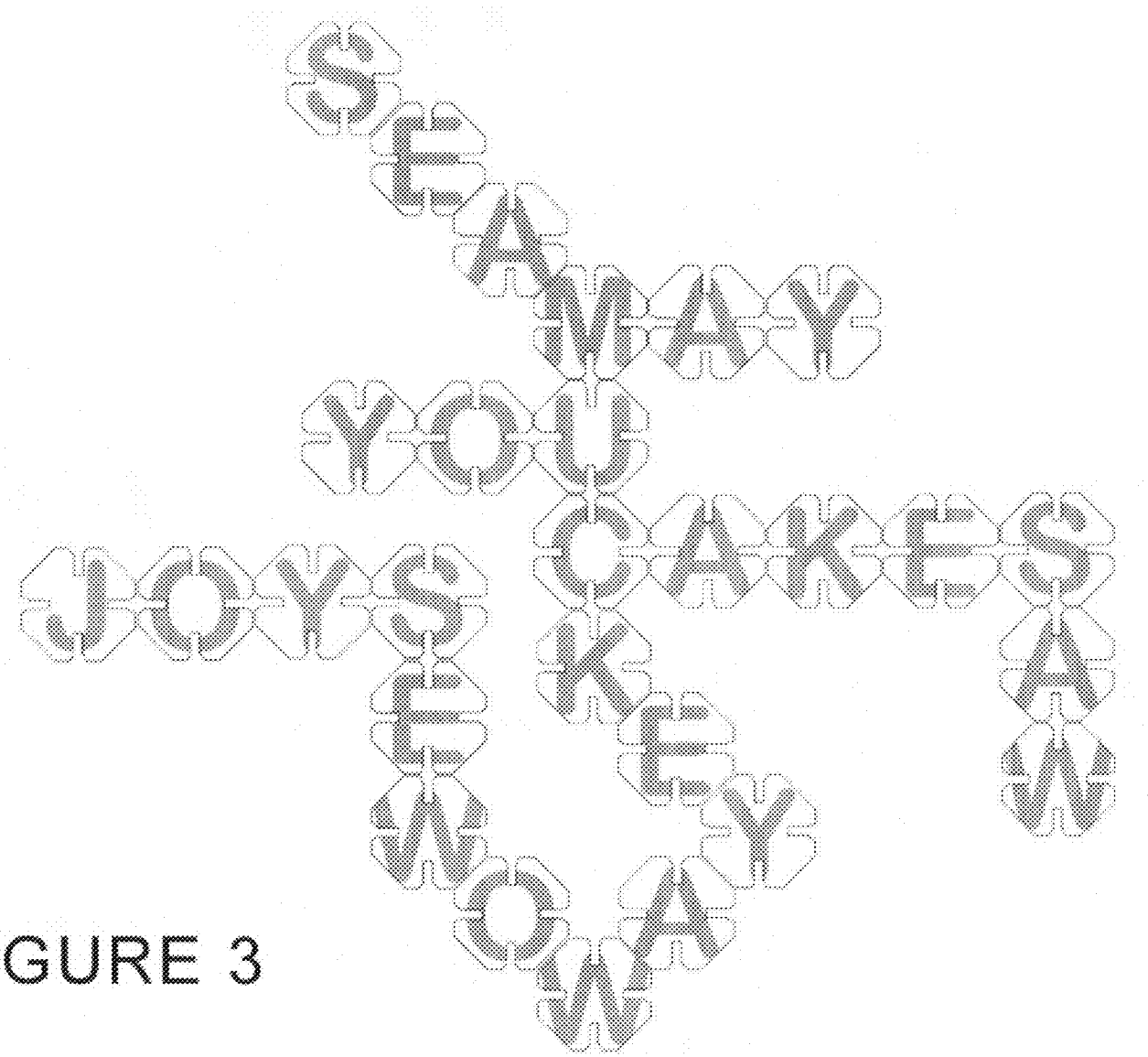
FIG. 3 is a front view of a plurality of game pieces arranged in ways to make words horizontally, vertically and at diagonal angles.
Figure 6:
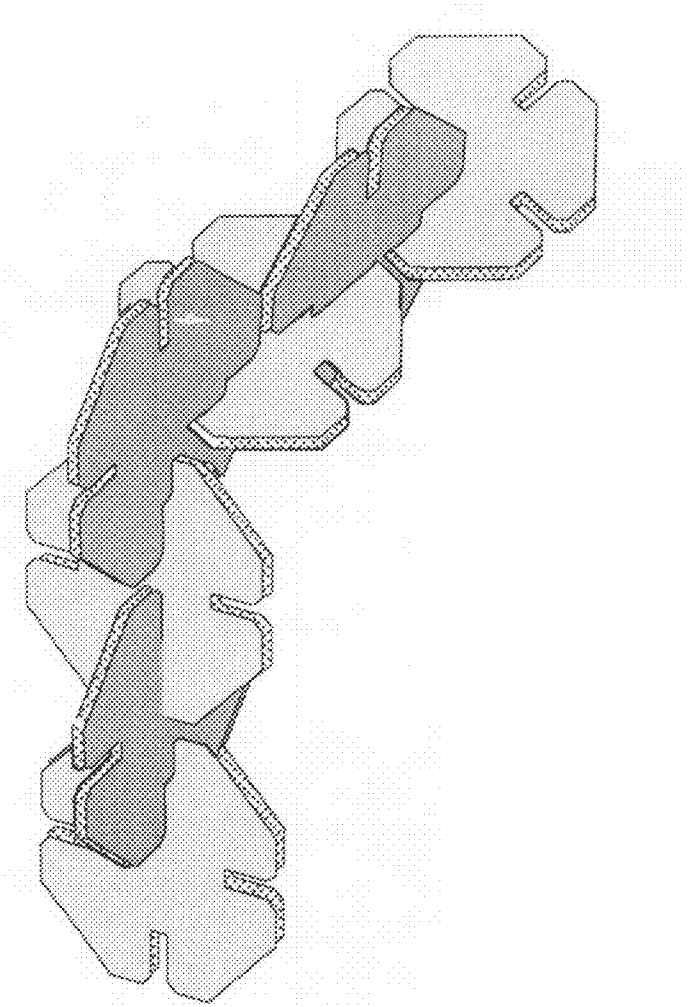
FIG. 6 is a perspective view of a plurality of game pieces interlocked both vertically and horizontally.

One embodiment of the game piece 1*c* is illustrated in FIG. 1. The game piece 1*c* has a plurality of sides. These sides may be of equal length (i.e., equilateral), and may or may not have an opening, notch, cut-out, cut-away, or indentation in the middle of any given side. Said opening or notch may run at a ninety degree angle to the outer perimeter of the side (i.e., perpendicular to the side) or at any other angle to the outer perimeter of said side. The open end of said opening or notch is shaped to be wider on an outer perimeter whereby the interlocking of at least two game pieces and/or at least one game piece and one base piece is enhanced. The width of the notches will be dictated by the thickness of the material used to make the game pieces. Said width should be only slightly greater than the thickness of the material used to make the game pieces so that the game pieces will connect easily and remain firmly attached once interlocked. The depth, length, or degree of indentation is dependent on the material used to make the game pieces, and the surface area desired to be visible and unobscured when said pieces are interlocked. The game pieces comprise one or more layers, the layers comprised of a material selected from a group consisting of paper, cardboard, styrofoam, solid wood, plywood, wood veneers, vinyl, plastic, a polymer, thin solid wood, foam-core and combinations of two or more of such materials The optimum number of sides and shape for the game pieces is not set, however, a very useful configuration is a polygon composed of eight sides of equal length. Eight sides will allow the pieces (once printed with letters and/or numbers and/or indicia on one face, as shown in FIG. 2), to be positioned side-by-side in a vertical, horizontal, and/or diagonal fashion to create words, as shown in FIG. 3. Additionally, the octagonal shape of the game pieces will allow a total of four openings or notches to be set every ninety degrees (i.e., perpendicular to each other) so that when the game pieces are interlocked, the lettered or numbered faces of said pieces can be read from an overhead perspective (i.e., viewing the letters and words from above) as shown in FIG. 10 and/or perspectives that are perpendicular to an overhead perspective (i.e., viewing the letters and words from the side) as show in FIGS. 8, 9 and 11. The basic octagonal shape of the game piece and the perpendicular notches or openings also enable said game pieces to be interlocked vertically and/or horizontally as shown in FIG. 6.

While a variety of different fonts or typefaces can be used if and when letters are incorporated onto the front face of the game pieces, sans serif fonts or typefaces as shown in FIGS. 2, 3, 8, 9, 10 and 11 will create the most legible words when game pieces and/or base pieces are interlocked.

Using an octagon (i.e., having eight sides of equal length) as the basic shape of the game piece, the optimum depth of the openings or notches should be about one-third the maximum width of the game piece. The angle of the taper on the open-end of the notches or openings is not critical, however, an angle of forty-five degrees is very functional and facilitates easy interlocking of the game pieces as shown in FIG. 1*a*. Whatever the angle of taper of the open end it is shaped to be wider on an outer perimeter whereby the interlocking of at least two game pieces and/or at least one game piece and one base piece is enhanced. The width of the notches is dependent on the thickness of the game piece material. Inasmuch as it is desirable to have durable, light, strong game pieces that can easily be interlocked vertically several pieces high and/or interlocked horizontally several pieces wide using solid wood and/or laminated materials comprised of paper, foam-core, solid wood, plastic, and wood veneers are good choices. Using such materials a functional range of widths for the notches is from about 3 mm to one-half inch.

Figure 4:
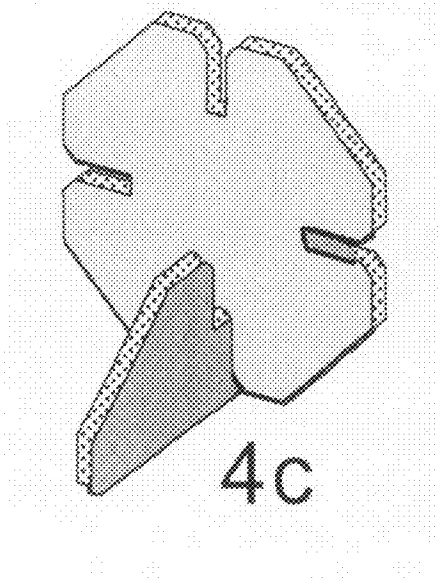
FIG. 4 is a perspective view of a base piece, a game piece, and the base piece and game pieces interlocked perpendicularly in a stable manner.
Figure 4:
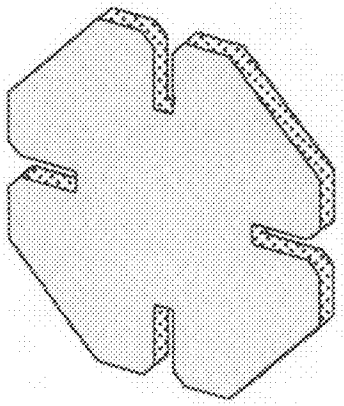
Figure 4:
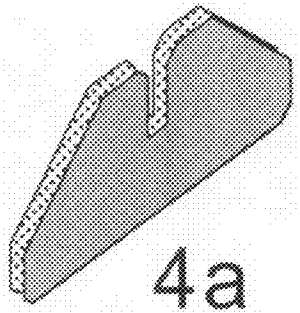

One embodiment of a base piece is illustrated in 1*d* of FIG. 1 also see 4*a* of FIG. 4. The base piece 1*d* has a plurality of sides. At least two of these sides may be of equal length (i.e., equilateral), and at least one side has an opening or notch, in the middle of said side. Said opening or notch as shown in FIG. 1 at 1*b*, may run at a ninety degree angle to the top-most side (i.e., perpendicular to the top-most side) or at any other angle to said side. The open end of said opening or notch is shaped to be wider on an outer perimeter whereby the interlocking of at least two game pieces and/or at least one game piece and one base piece is enhanced, as shown in FIG. 4 at 4*c*. The width of the notches or openings will be dictated by the thickness of the material used to make the game pieces. Said width should be only slightly greater than the thickness of the material used to make the game pieces so that the game pieces will connect easily and remain firmly attached once interlocked. The depth, opening or notch length, or degree of indentation is also dependent on the material used to make the base pieces, and the surface area desired to be unobscured when said pieces are interlocked with the game pieces. The base pieces comprise one or more layers, the layers comprised of a material selected from a group consisting of paper, cardboard, styrofoam, solid wood, plywood, wood veneers, vinyl, plastic, a polymer, thin solid wood, foam-core and combinations of two or more of such materials and/or layers.

The optimum number of sides for the base pieces is not set, however, a very useful number is six, which forms a modified isosceles trapezoid roughly resembling a "chopped-off pyramid" shape as shown in FIG. 1*d*. Such a pyramid shape (with the top "chopped off") will allow the base pieces to be interlocked vertically with the bottom notch of the game pieces.

The lowest edge of the game piece and the lowest edge of the base piece would create an "+" shaped surface which will provide stability to whatever structure the interlocking game pieces create above an interlocked game piece and base piece resting on a flat surface.

Using a six-sided modified isosceles trapezoid roughly resembling a "chopped-off pyramid" shape for the base pieces, the optimum depth of the notches in the base piece should not exceed one-half the maximum height of the base piece. The angle of the taper on the open-end of the notches is not critical, however, an angle of forty-five degrees as shown in FIG. 1*a* is very functional and facilitates easy interlocking of the base pieces and the game pieces. The width of the notches is dependent on the thickness of the game piece material. Inasmuch as it is desirable to have durable, light, strong base pieces that can easily be interlocked with the game pieces, using thin solid wood and/or laminated materials comprised of paper, foam-core, plastic, and wood veneers are good choices. Using such materials a functional range of widths for the notches is from about 3 mm to one-half inch.

One embodiment of the game pieces printed with letters and numbers is illustrated in FIG. 2. In as much as the game pieces are thin and relatively flat, they show the two largest surfaces, the front and back faces (seen as the "front" and "back") when the game piece is standing up on its thin edge. One of these faces will remain unadorned and/or will be identical to the appearance of the same face on all other game pieces. The reverse face however, may be imprinted with a letter, number, or other indicia as shown in FIG. 2. Said letters, numbers, or indicia are sans serif and positioned so that they can be easily read even with the notches in the game pieces and from above or from the side when the game pieces are interlocked vertically and/or horizontally.

FIGS. 3,4,5,6,8,9,10 and 11 show how the game operates. The game pieces can be used in two ways; without interlocking the game pieces and/or interlocking of the game pieces. Using the game pieces without interlocking them is illustrated in FIG. 3. As shown in FIG. 3, words can be created by positioning game pieces adjacent to each other horizontally to form words (e.g., MAY, YOU, CAKES, JOYS) or vertically (e.g., MUCK, SEW, SAW), or diagonally reading left-to-right downwards (e.g., SEAM, WOW, KEY), or adjacent diagonally reading left-to-right upwards (e.g., WAY).

Figure 5:
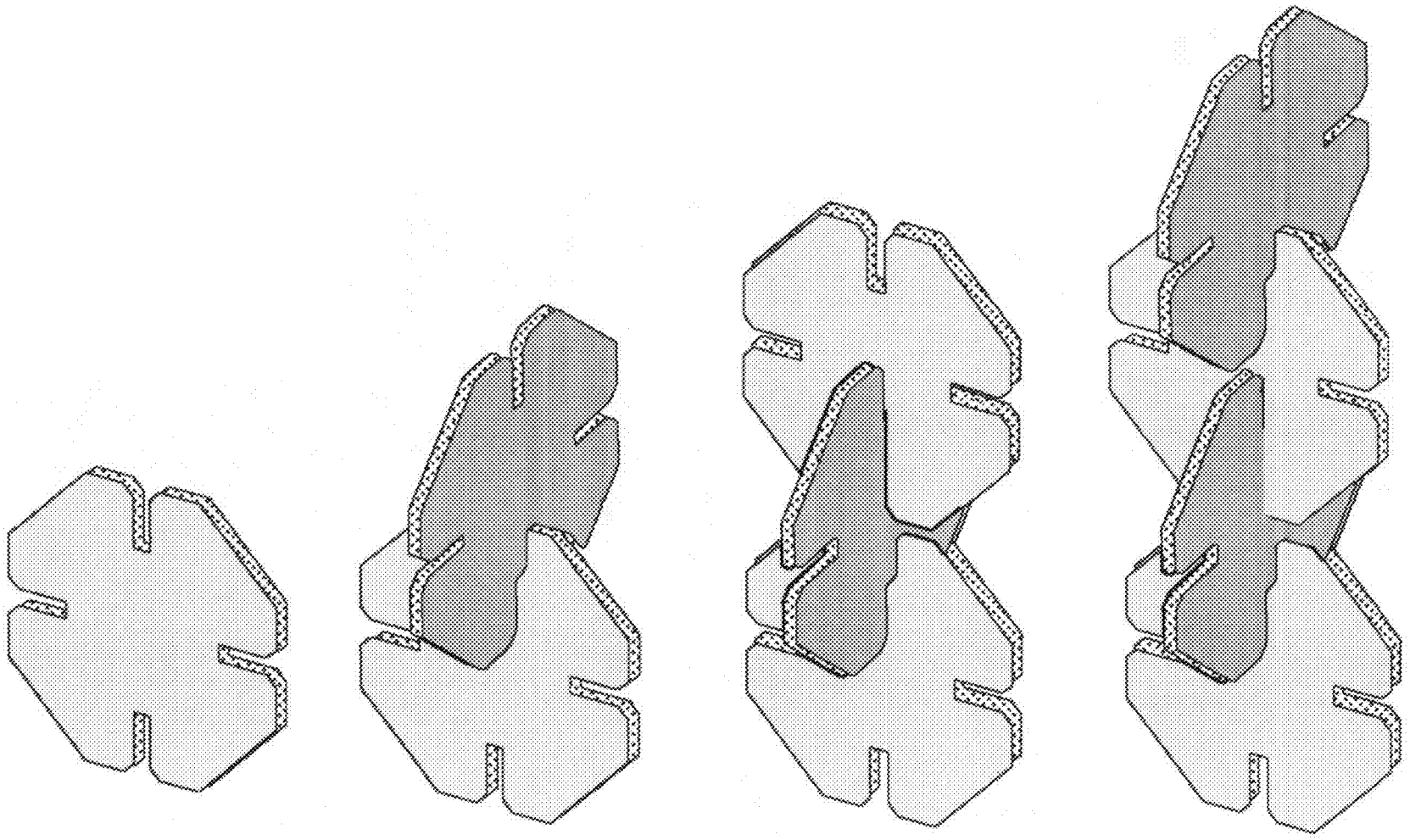
FIG. 5 are perspective views showing how a plurality of game pieces interlock perpendicularly along a vertical axis.
Figure 8:
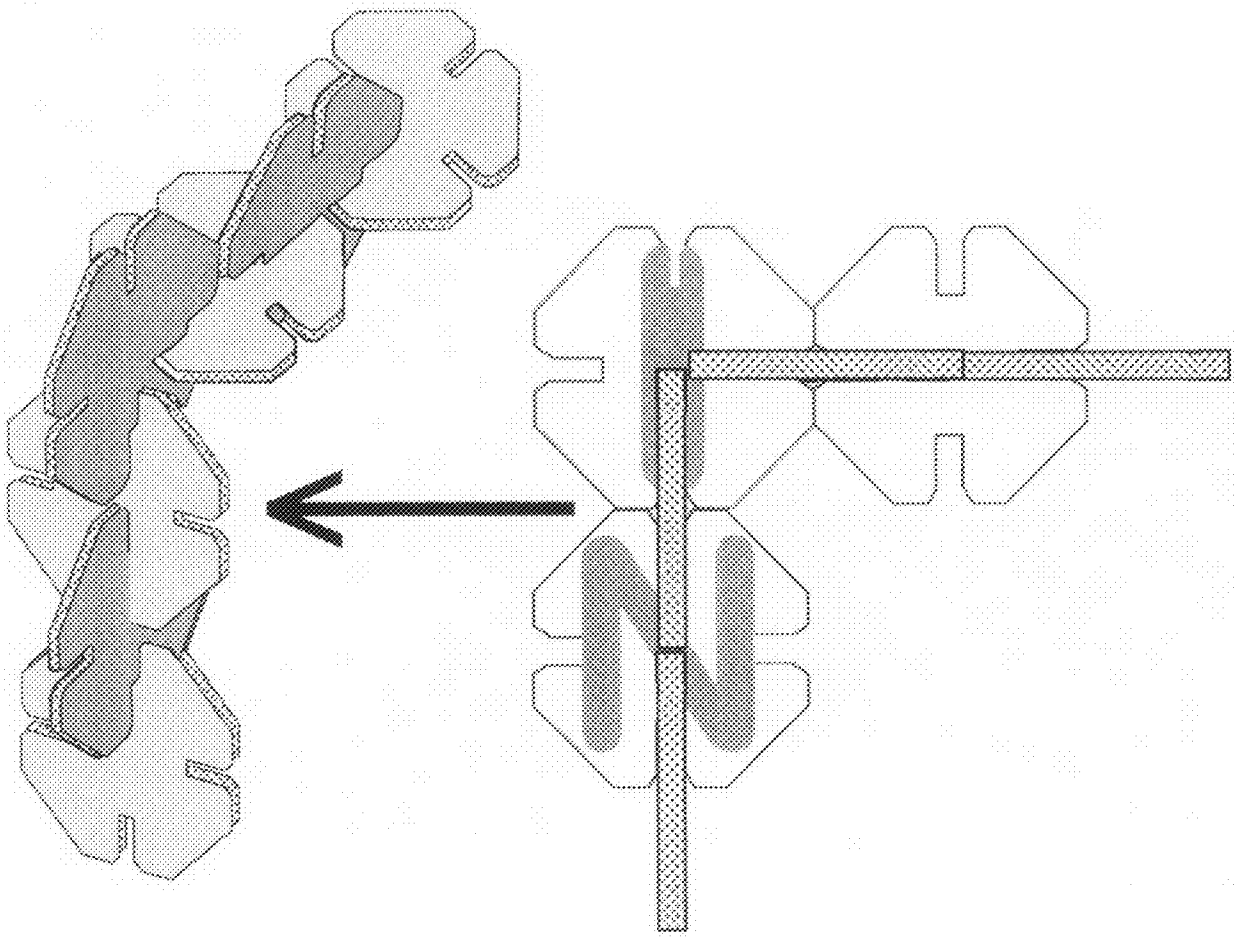
FIG. 8 shows the word "IN" formed by two game pieces when a structure like that shown in FIG. 6 is read from top to bottom when viewed on the right side.

FIG. 4 provides a perspective view of a base piece interlocked with a game piece. Creating this interlocked base structure provides stability for vertically stacked game pieces as shown in the progression illustrated in FIG. 5. As shown in FIG. 5, by placing the thin edge of two or more game pieces at ninety degrees to each other and interlocking them, a vertical structure can be created. The words created by the letters and/or numbers on the game pieces in said structure can be read both on the plane created by the printed game piece surface facing the viewer as well as on the plane created ninety-degrees to the viewer by the stacked, printed game pieces. FIG. 6 shows a perspective view of game pieces interlocked both vertically and horizontally. In such a configuration, the words created by the letters and/or numbers on the game pieces in said structure may be read from at least four perspectives:

1) From top to bottom when viewed from the right side as shown in FIG. 8

Figure 9:
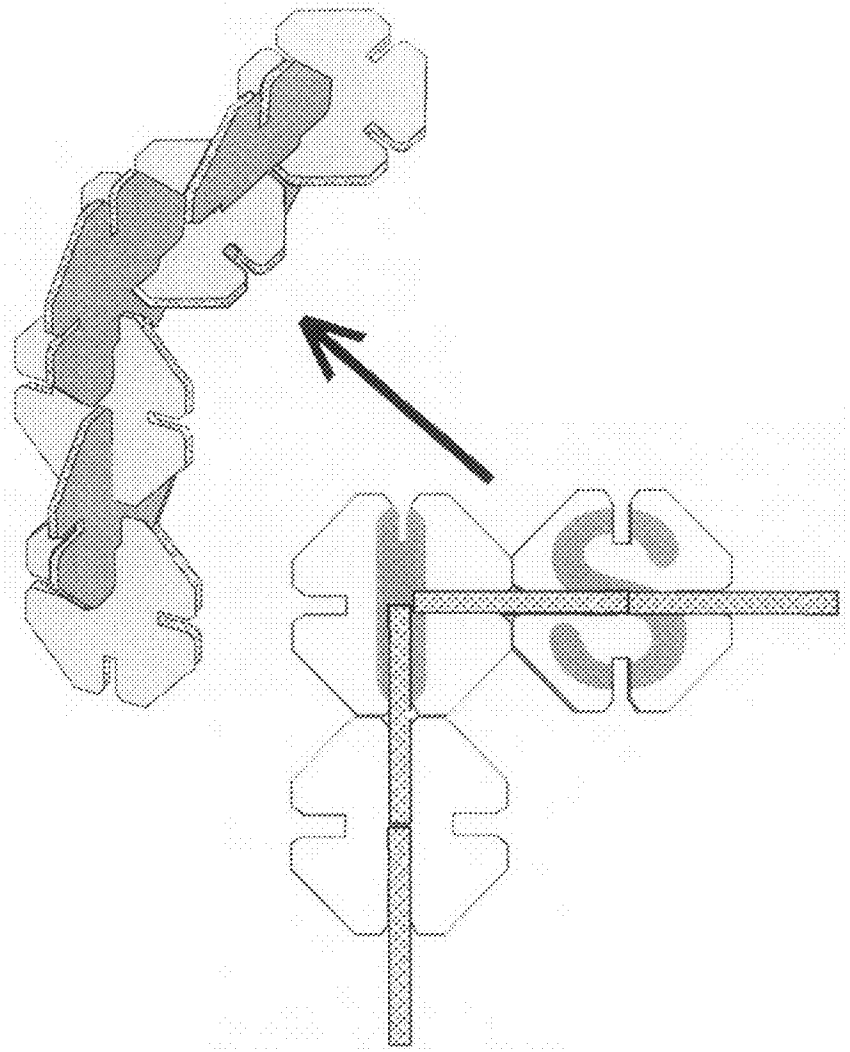
FIG. 9 shows the word "IS" formed by two game pieces when a structure like that shown in FIG. 6 is read from left to right when viewed on the right side.
Figure 10:
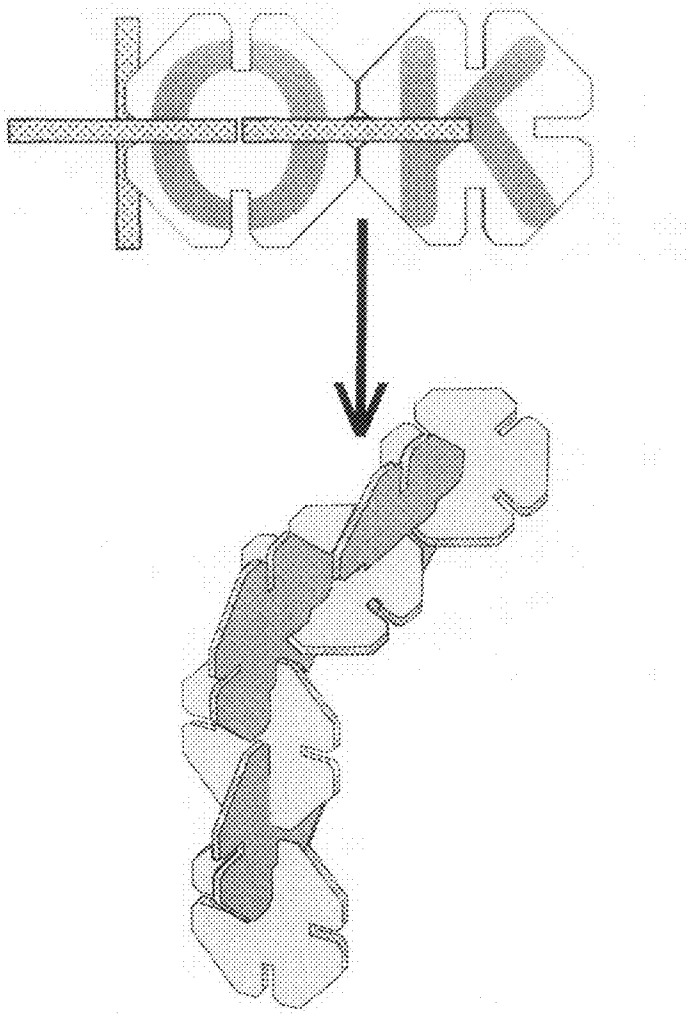
FIG. 10 shows the word "OK" formed by two game piece when a structure like that shown in FIG. 6 is read from left to right when viewed from above the structure looking down.

2) From left to right when viewed from the right side as shown in FIG. 9.

3) From left to right when viewed from above looking down as shown in FIG. 10.

Figure 11:
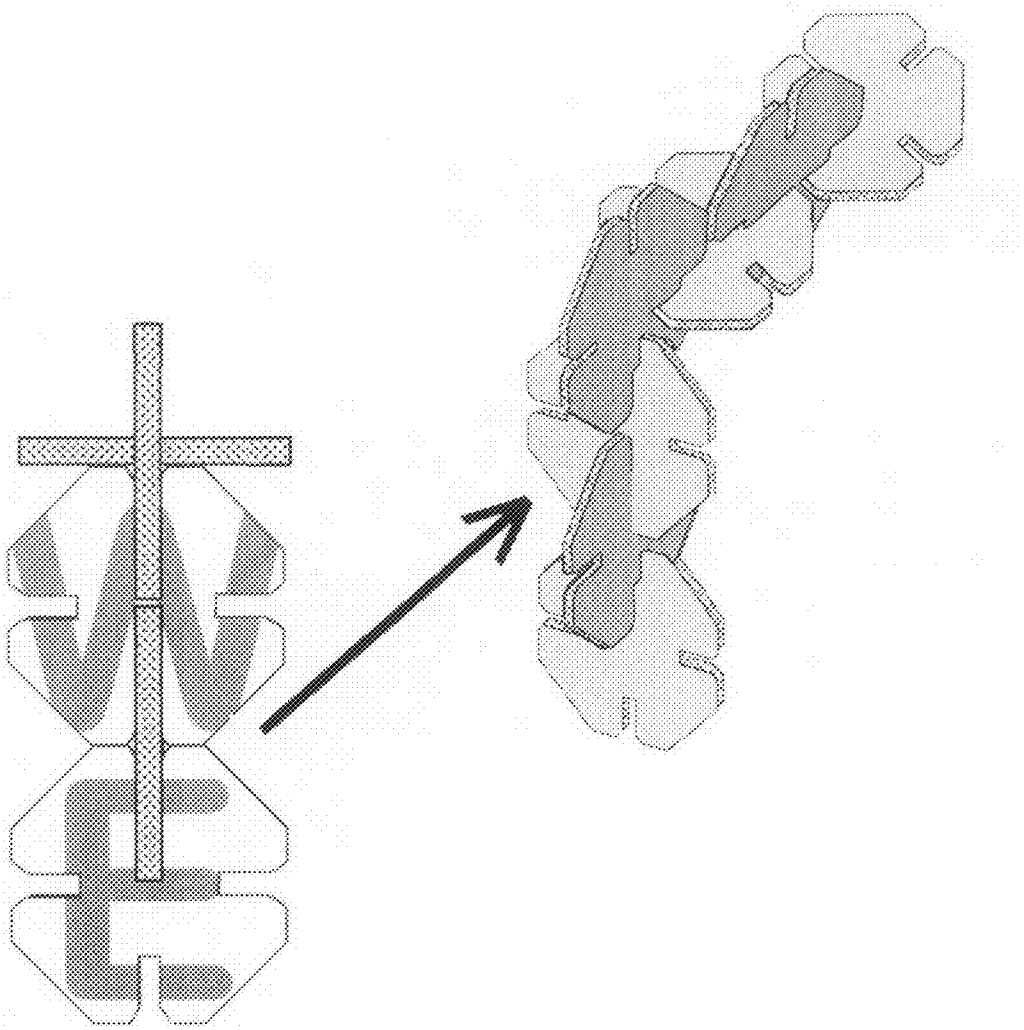
FIG. 11 shows the word "WE" formed by two game pieces when a structure like that shown in FIG. 6 is read from top to bottom when viewed from the front of the structure looking towards the back of the structure

4) From top to bottom when viewed from front to back as shown in FIG. 11.

Advantages

From the description above, a number of advantages of my word game apparatus include, but are not limited to:

(a) Making the game pieces with more than four sides enables players to create words diagonally as well as along traditional vertical and horizontal axes. Using the basic shape of an equilateral octagon for game piece adds up to four additional directions in which words can be formed on a flat surface, thus greatly increasing the skill, challenge, excitement and fun of game play.

(b) Putting tapered notches into the game pieces enable said game pieces to interlock easily to create vertical and/or horizontal structures that can be several game pieces wide or tall, adds yet another level of complexity to creating words with the game pieces. So in addition to adding the ability to create words diagonally on a flat surface (e.g., a tabletop) as mentioned above the apparatus disclosed herein allow players to create words in not just two dimensions, but three. This ability to create words upwards above a flat surface (e.g., a table or desktop) and sideways adds unique and rather complex possibilities to the challenge of game play.

(c) The notched base piece adds stability, structural integrity and strength to the stacked/interlocked game pieces as players create free form structures above the interlocked game and base pieces resting on a flat surface (e.g., a table or desktop).

(d) As structures created become larger and more complex, a good sense of design, balance, basic physics and even engineering will be helpful to the player. Such qualities are often found in persons with an analytic or quantitative nature. At the same time, having a wide vocabulary, being articulate and possessing a good command of the language will also be important to players. Thus, if the object of the game is to create complex, long, multi-lettered words, that are formed into intricate, yet balanced, solid, stable structures this word game may present the perfect arena to pit highly literate "English majors" against quantitative "Engineers".

(e) Because of the very tactile nature of the game apparatus, and the variety of ways they can be used to create words, they may prove valuable in helping children learn to write (i.e., form) words and read them (left-to-right, top-to-bottom, as well as diagonally).

(f) Greater hand-eye coordination, development of manipulative skills as well as improvement of construction skills may also result from playing with the proposed game pieces. Thus, the proposed game pieces could also be used as a teaching tool in a variety of ways.

(g) Inasmuch as there is no game board included in the apparatus players are less restricted in how they go about creating structures using the game pieces and base pieces in the disclosed word game apparatus. The absence of a game board not only adds greater freedom, creativity and complexity to game play, but it also make the apparatus more compact and more easily stored and/or transported.

Figure 7:
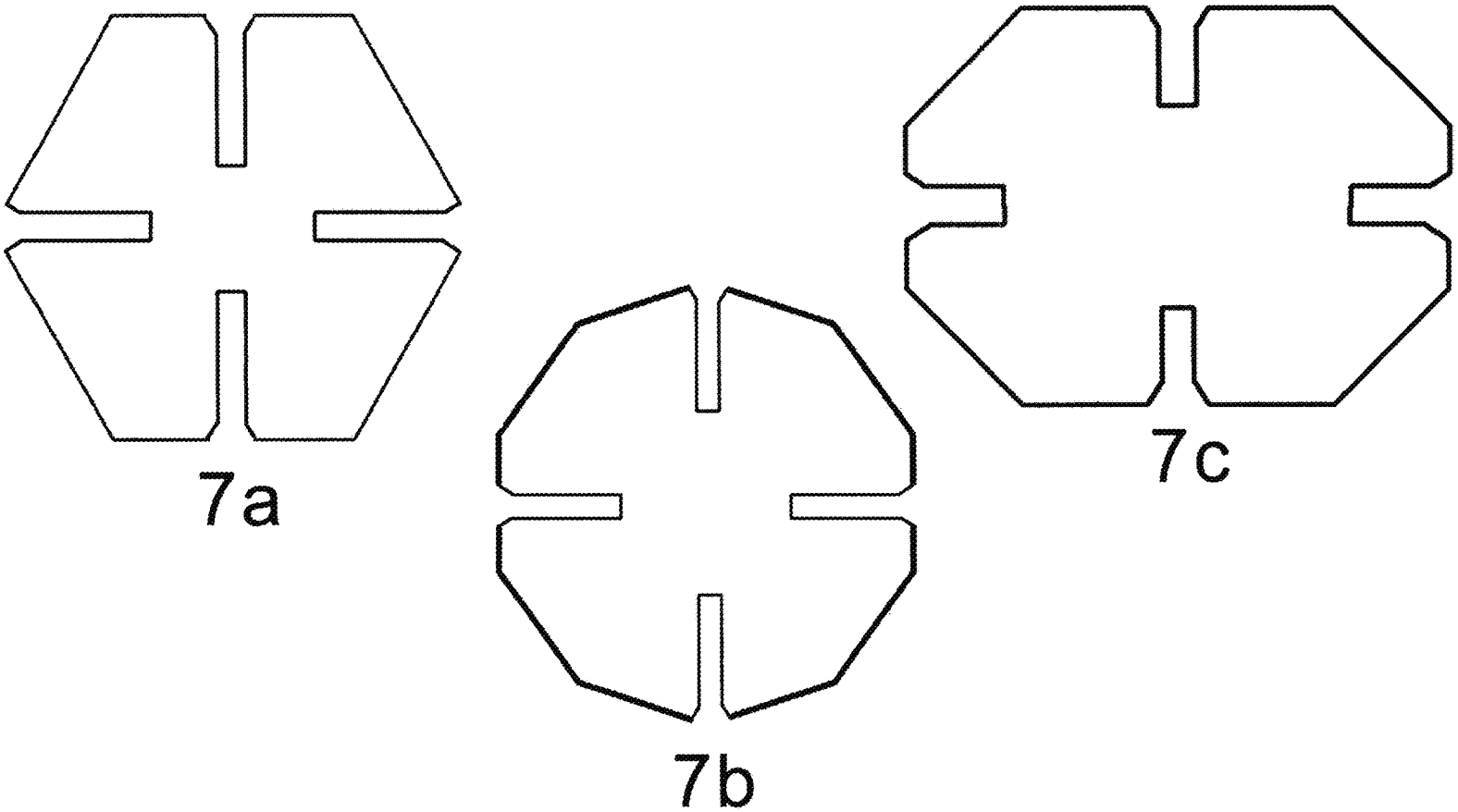
FIG. 7 shows front views of three alternative shapes for game pieces.

Alternative embodiments of the proposed game pieces are shown in FIG. 7. These include: (a) A six-sided game piece shown in FIG. 7*a*. This shape can contain the same four tapered notches in the basic octagon shaped piece (the first embodiment) shown at FIG. 1*c* in FIG. 1. This hexagon shape would be interlockable both vertically and horizontally. However, hexagon shaped game pieces would not allow words to be made up by placing said pieces next to each other horizontally. Thus, such a six-sided basic shape would not be as versatile as the octagon shown in the first embodiment. (b) A ten-sided game piece shown in FIG. 7*b*. This shape can contain the same four tapered notches in the basic octagon shaped game piece (the first embodiment) shown at FIG. 1*c* in FIG. 1. Thus the decagon shape would be interlockable both vertically and horizontally. However, decagon shaped game pieces would not allow words to be made up by interlocking placing said pieces next to each other along a vertical axis because the top and bottom of the decagon are prone to make the piece tilt left or right. Thus, such a ten-sided basic shape would not be a versatile as the octagon shown in the first embodiment. (c) An eight-sided game piece with unequal sides shown in FIG. 7*c*. This shape contains the four tapered notches similar to the basic octagon shaped game piece (the first embodiment) shown at FIG. 1*c* in FIG. 1. Thus this shape would be interlockable both vertically and horizontally. However, since not all sides are of equal length, they would not allow words to be made up as neatly by interlocking said pieces next to each other vertically and/or horizontally as they would if all eight sides were equal. Interlocking these game pieces would result in words with uneven and irregular word spacing between the letters. Which is to say, vertically read words will be spaced differently than ones read horizontally. And although the word(s) could be read, it would not appear as aesthetically pleasing as it would if all sides of the game piece were of equal length. Furthermore, the structural integrity of the interlocked game pieces (having sides of unequal length) would not as great as a similar structure made form interlocking game pieces having sides of the same length. This is because interlocked notches of the uneven sides would have less surface area contact and thus less adhesion and friction to hold such connections firmly in place. In short, the octagon shape at FIG. 7*c* is inferior to the first embodiment shown at FIG. 1*c* in FIG. 1.

Operation—FIGS. 3,4,5,6,8,9,10 and 11

The word game apparatus may be used to form words on a two-dimensional (flat) surface as shown in FIG. 3, or alternatively, to form words in three-dimensions including parallel to and vertically above a flat surface as shown in FIGS. 4, 5, 6, 8, 9, 10 and 11.

The method for playing a two-dimensional word game by a plurality of players comprising steps of:

a) providing a plurality of game pieces, the game pieces having a front face, a back face and a plurality of sides with at least two sides having a notch and/or indentation and/or cut-out opening on said sides with each notch and/or indentation and/or cut-out opening being closed some distance from said side, at least some of the front faces having an appearance, letter, indicia or markings on their faces and at least some of the back faces having an appearance, indicia or markings on their faces;

b) initially allocating to each said player i) a predetermined number of randomly selected game pieces from said plurality of game pieces or ii) a set of game pieces comprising a predetermined number that is identical in number and in appearance, letter, indicia or markings on the front faces of the game pieces, in other words, each player gets the same number and type of game pieces;

c) all players agreeing on a set time limit for game play;

d) each player forming words, numbers, formulae, equations and/or other things on a flat surface along a vertical and/or horizontal and/or diagonal axes by placing the game pieces adjacent to each other as shown in FIG. 3;

e) determining a winner of the game based on the player who within the set time limit for game play forms the most words and/or numbers and/or formulae and/or equations and/or other things and has the least unused game pieces.

The method for playing a three-dimensional word game by a plurality of players comprising steps of:

a) providing a plurality of game pieces, the game pieces having a front face, a back face and a plurality of sides with at least two sides having a notch and/or indentation and/or cut-out opening on said sides with each notch and/or indentation and/or cut-out opening being closed some distance from said side, at least some of the front faces having an appearance, letter, indicia or markings on their faces and at least some of the back faces having an appearance, indicia or markings on their faces and a plurality of base pieces, the base pieces having a plurality of sides and at least one notch and/or indentation and/or cut-out and/or opening on at least one of the plurality of sides with each notch and/or indentation and/or cut-out opening being closed some distance from said side, at least some of the front faces having the same appearance, indicia or markings as the appearance, indicia or markings on their back faces;

b) initially allocating to each said player a set of game pieces and base pieces that is identical in number and in appearance, letter, indicia or markings on the front faces of the game pieces, in other words, each player gets the same number and type of game pieces;

c) all players agreeing on a set time limit for game play;

d) each player forming one or more words, numbers, formulae, equations and/or other things along a vertical axis or axes perpendicular to the surface on which the interlocked game piece and base piece rest and/or parallel to a flat surface as shown in FIGS. 4, 5, 6, 8, 9, 10 and 11, on which the interlocked game piece and base piece rest, as shown in FIG. 4;

e) determining a winner of the game based on the player who within the set time limit for game play forms the most and/or longest words and/or numbers and/or formulae and/or equations and/or other things, has the least unused game pieces, and has the most complex, but also most stable structure.

I claim:

1. A three dimensional word, number, equation and/or formula construction game, without the use of a game board, comprising;

a) a plurality of game pieces, the game pieces having a front face, a back face and eight sides of equal length substantially in the form of a regular octagon, with at least two sides having a single notch in each them, said notch being perpendicular to the side it is on, extending radially inward from the middle of said side, said notches being set perpendicular to each other, said notch widens where it opens onto the middle of the side of said game piece it is perpendicular to, whereby the interlocking of game pieces with other game pieces and an interlocking of game pieces with base pieces is enhanced, at least some of the faces on the plurality of game pieces having thereon a number, letter, or indicia for use in the game, said numbers, letters or indicia are positioned so they can be easily read even if the game pieces have notches in them, whereby interlocked game pieces having a number, letter or indicia on their faces can form readily legible words, numbers, equations and/or formulae along any one of three orthogonal axes, and b) a plurality of base piece means for holding and supporting one or more game pieces in an interlocking manner, each base piece having a front face, a back face, and a plurality of sides substantially in the form of a trapezoid, at least two sides being of equal length, with only one side of the base piece having a notch in it, said notch extending inward perpendicularly from the middle of the side opposite the longest side of the base piece, said notch widens where it opens onto the middle of the side of said base piece it is perpendicular to, whereby the interlocking of game pieces with said base pieces is enhanced, wherein said notches in the interlocked base and the notches in the game piece are sized with respect to the game and base pieces so as to form a "+" shaped edge composed composed of the lowest side of the regular octagon shaped game piece and the longest side of the base piece, said "+" shaped edge being substantially in the same plane in full contact with a surface on which it rests, and c) instructions for playing the game.

2. The apparatus of claim 1 wherein the game pieces comprise one or more layers, the layers comprised of a material selected from a group consisting of paper, cardboard, styrofoam, solid wood, plywood, wood veneers, vinyl, plastic, a polymer, thin solid wood, foam-core and combinations of two or more of such materials.

3. The apparatus of claim 1 wherein the base pieces comprise one or more layers, the layers comprised of a material selected from a group consisting of paper, cardboard, styrofoam, solid wood, plywood, wood veneers, vinyl, plastic, a polymer, thin solid wood, foam-core and combinations of two or more of such materials.

4. The apparatus of claim 1 wherein the letters on at least some of the front faces of the game pieces are in a sans serif font and/or typeface.

5. The apparatus of claim 1 wherein at least some of the base pieces have six sides.

6. The apparatus of claim 5 wherein the base pieces comprise one or more layers comprised of a material selected from a group consisting of paper, cardboard, styrofoam, solid wood, plywood, wood veneers, vinyl, plastic, a polymer, thin solid wood, foam-core and combinations of two or more of such materials.

7. The apparatus of claim 6 wherein at least some of the base pieces have six or more sides.

* * * * *